US005090679A

United States Patent [19]

Maekawa et al.

[11] Patent Number: 5,090,679

[45] Date of Patent: Feb. 25, 1992

[54] SHEET FEEDING DEVICE

[75] Inventors: Takashi Maekawa; Morimoto Kiyoshi, both of Osaki, Japan

[73] Assignee: Mita Industrial Co., Ltd., Osaka, Japan

[21] Appl. No.: 524,636

[22] Filed: May 16, 1990

[30] Foreign Application Priority Data

May 19, 1989 [JP] Japan ..... 1-58482[U]

[51] Int. Cl.[5] ..... B65H 3/52

[52] U.S. Cl. ..... 271/125; 271/121

[58] Field of Search ..... 271/121, 113, 124, 125, 271/161

[56] References Cited

U.S. PATENT DOCUMENTS 4,535,981 8/1985 Watanabe et al. ..... 271/121
4,865,306 9/1989 Himegi ..... 271/121
4,887,806 12/1989 Tanaka et al. ..... 271/121

FOREIGN PATENT DOCUMENTS 244733 12/1985 Japan ..... 271/121
221023 10/1986 Japan ..... 271/121
117142 5/1989 Japan ..... 271/113

*Primary Examiner*—H. Grant Skaggs
*Assistant Examiner*—Carol Lynn Druzbick
*Attorney, Agent, or Firm*—Koda and Androlia

[57] ABSTRACT

A sheet feeding device is provided with a guide member for guiding sheets of paper sent out from the paper pile section in the sheet feeding direction, a feeding roller which is installed above the guide member and by which a sheet of paper is transferred in the sheet feeding direction, and a separation member which is engaged in non-contact with the feeding roller in the axial direction thereof and by which sheets of paper can be separated sheet by sheet between the separation member and the feeding roller and is so composed that a separation portion formed between the feeding roller and the separation member can be arranged in the downstream side in the sheet feeding direction from a minimum clearance portion formed between the guide member and the feeding roller.

7 Claims, 5 Drawing Sheets (a)
[PRIOR ART]

(b)
[PRIOR ART]

SHEET FEEDING DEVICE

BACKGROUND OF THE INVENTION

1. Field of the Invention

The present invention relates to a sheet feeding device which is preferably utilized in an image forming apparatus such as a document copying machine, a laser beam printer, etc., and more particularly relates to an improvement in a separation mechanism to separate sheets of paper which are sent out from a paper pile section.

2. Description of the Prior Art

It is well known to the public that this kind of a sheet feeding device is of such a type as is provided with a feeding roller to transfer sheets of paper and a pad or a separation roller which is alternately engaged to the feeding roller in the axial direction and which can separate sheets of paper therebetween as a separation mechanism to separate sheets of paper.

There are two types of the above separation mechanism, one of which is such a type that the feeding roller and the pad or the separating roller are brought into contact with each other, and the other of which is a non-contact type as disclosed in the Japanese Utility Model Laid-Open No. Sho-63-45732 and the Japanese Laid-Open No. Sho-63-48744. And both of these types have advantages and disadvantages in the sheets separating capacity and the sheet feeding capacity pertaining to presence of traces of rolls on the sheet.

The sheet feeding device 1' shown in FIG. 5 and FIG. 6 is attached to a document copying machine provided with a double-side copying feature. The sheet feeding device 1' comprises a guide plate 4 as a guiding member which is fixed at the side of a document copying machine along with the sheet feeding direction (arrow "S") and which guides sheets of paper 3 which are in stock on the intermediate tray 2 after an image has been formed on a single side thereof from the intermediate tray 2 in the sheet feeding direction by means of a transfer roller 7 at the side of the document copying machine, a feeding roller 5 of which axis 8 is arranged at the side of a document copying machine with a right angle to the sheet feeding direction and by which sheets of paper 3 can be sent in the feeding direction, and a pad 6' made of rubber having elasticity, which is provided in parallelism with the axis 8 at the side of a document copying machine and can separate sheets of paper 3 sheet by sheet between the pad 6' and the feeding roller 5, thereby causing the sheets of paper 3 to be separated sheet by sheet and to be sent for forming an image on the other side thereof.

The feeding roller 5 and the pad 6' are engaged alternately in non-contact with each other in the axial direction thereof and respective engaging portions thereof constitute a separation portion 9. The separation portion 9 are so set that they can be located at the position on a line "C" can pass through a minimum clearance portion formed between the feeding roller 5 and the guide plate 4 and can intercross at right angles with the guiding surface "l" of the guide plate 4.

Such a sheet feeding device 1' is so composed that sheets of paper 3 can be separated sheet by sheet and can be sent by utilization of the difference of friction forces Frc, Fcc, and Fcp which occur between the feeding roller 5 and sheets of paper 3, between mutual sheets of paper 3 and between sheets of paper 3 and the pad 6' when a sheet of paper 3 passes through the separation portion 9 with the sheet of paper 3 made wave-like in the axial direction. Hence, the strength of the friction forces has been adjusted in the order to Frc>Fcp>Fcc.

Therefore, even though a plurality of sheets of paper 3 are carried in between the feeding roller 5 and the pad 6', only a sheet of paper 3 at the uppermost layer which is in contact with the feeding roller 5 is separated by the difference of the friction forces and is transferred in the separation portion 9. The other sheets of paper 3 lower than the second sheet of paper 3 can be retained by the inclined face of the pad 6', which is inclined from the guide plate 4 toward the feeding roller 5 at the separation portion 9 or beforehand thereof.

On the other hand, as an intermediate tray 2 which has a large stock capacity is needed by influence of recent mass information tendency, an intermediate tray 2 of which height "T" of sheets accommodation is high has been employed. Thereby, the number of sheets of paper 3 which may be carried in the separation portion 9 simultaneously has been diversified.

For instance, as shown in FIG. 7(*a*), in the case one or two sheets of paper 3 are carried in, the leading edge of the sheets of paper 3 is bent downwards and is brought into contact with the guide plate 4 and the leading side from the portion "d" is bent in the feeding direction (an arrow "S").

Next, the leading edge of sheets of paper 3 is guided along with the guiding surface "l" and is carried in the separation portion 9 where they can be separated sheet by sheet.

Hence, as shown in FIG. 7(*b*), in the case that a great deal of sheets of paper 3 are transferred from the intermediate tray 2 toward the separation portion 9 at a time, the leading edge of sheets of paper 3 is brought into contact with the face 6'*a* of the pad 6' and is made just like being jammed before the pad 6 in the sheet feeding direction. Under such a condition, in the case that the engaging width "a" of the separation portion 9 formed between the feeding roller 5 and the pad 6' is large, only the sheet of paper 3 at the uppermost layer is not further sent in beyond the point "Z" of intersection where the feeding roller 5 and the pad 6' intercross when being observed from the side thereof. Contrarily, in the case that the engaging width thereof is small, there may occur such a problem that a number of sheets of paper 3 are sent in toward the separation portion 9 at a time.

Especially, the main reason why a sheet of paper 3 is not further sent in from the above point "Z" of intersection at the edge at the upstream side in the sheet feeding direction of the separation portion 9 is further located at the upstream side in the sheet feeding direction than the minimum clearance portion located on the line "C" between the feeding roller 5 and the guide plate 4. Namely, as the clearance between the feeding roller 5 and the guide plate 4 gets more narrow toward the downstream side in the sheet feeding direction, the leading edge of a sheet of paper 3 which is in a jammed condition before the face 6'*a* of the pad 6' loses the degree of freedom thereof more as it goes further in the sheet feeding direction.

SUMMARY OF THE INVENTION

The present invention has been made to solve the above problems in the prior art.

It is therefore one of the objects of the invention to provide a sheet feeding device which can separate and feed only the sheet of paper at the uppermost layer without fail even though the condition for feeding sheets of paper to the separation portions is diversified.

Namely, the sheet feeding device comprise a guide member for guiding sheets of paper sent out from the paper pile section in the sheet feeding direction, a feeding roller which is installed above the guide member and by which a sheet of paper is transferred in the sheet feeding direction and a separation member which is engaged alternately in non-contact with the feeding roller in the axial direction thereof and by which sheets of paper can be separated sheet by sheet between the separation member and the feeding roller, and is characterized in that a separation portion formed between the feeding roller and the separation member is arranged in the downstream side in the sheet feeding direction from a minimum clearance portion formed between the guide member and the feeding roller.

In a sheet feeding device according to the invention, sheets of paper which are sent out from the paper pile section are guided in the sheet feeding direction by means of a guide member and are led up to the separation portion formed between the feeding roller installed above the guide member and the separation member which is engaged alternately in non-contact with the feeding roller in the axial direction thereof. At this time, as the separation portion is arranged in the downstream side in the sheet feeding direction from the minimum clearance portion formed between the guide member and the feeding roller, the leading edge of the sheet of paper only at the uppermost layer may become comparatively free after it passes through the minimum clearance portion even though a number of sheets of paper are led in the minimum clearance portion. For this reason, the sheets of paper are easily carried in the separation portion and separated sheet by sheet.

The specification of the present invention specifically points out the subject thereof and is complete with the claims clearly claimed. The above, and other objects, features and advantages of the present invention, will become apparent from the following description taken in conjunction with the accompanying drawings.

DETAILED DESCRIPTION OF THE PREFERRED EMBODIMENTS

Figure 5:
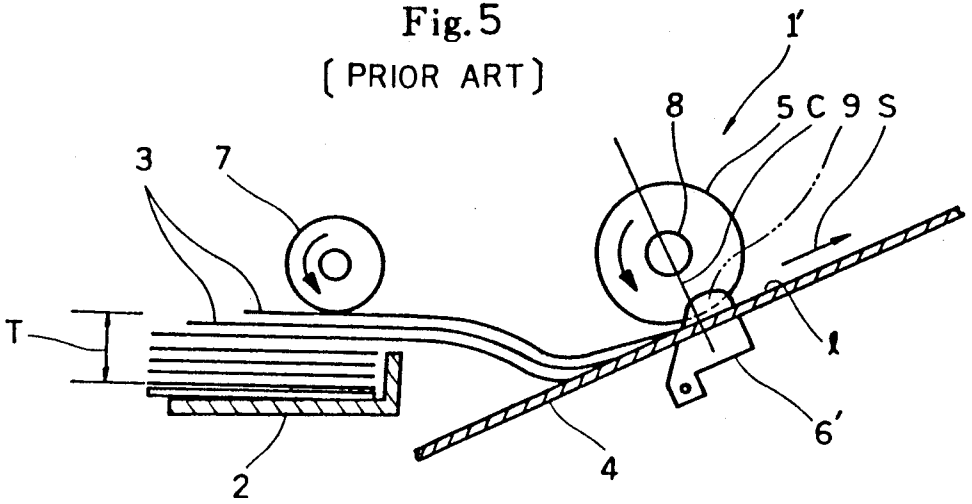
Fig. 5 (PRIOR ART)
FIG. 5 is a simplified constructional view observing a conventional sheet feeding device which is one of the examples of the background of the invention, from the side thereof.
Figure 6:
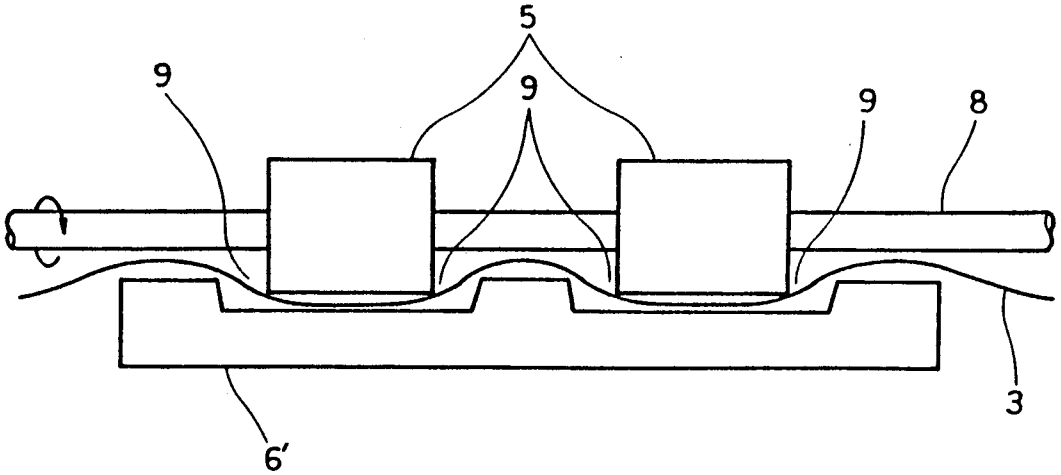
Fig. 6 (PRIOR ART)
FIG. 6 is a front construction view showing the feed roller and the pad of the conventional sheet feeding device, which are observed from the upstream side in the sheet feeding direction thereof, FIG. 7(*a*) is a view showing such a state that a small quantity of sheets of paper are carried in the feeding roller shown in FIG. 6, and FIG. 7(*b*) is a view showing such a state that a large quantity of sheets of paper are carried in the feeding roller shown in FIG. 6.
Figure 7:
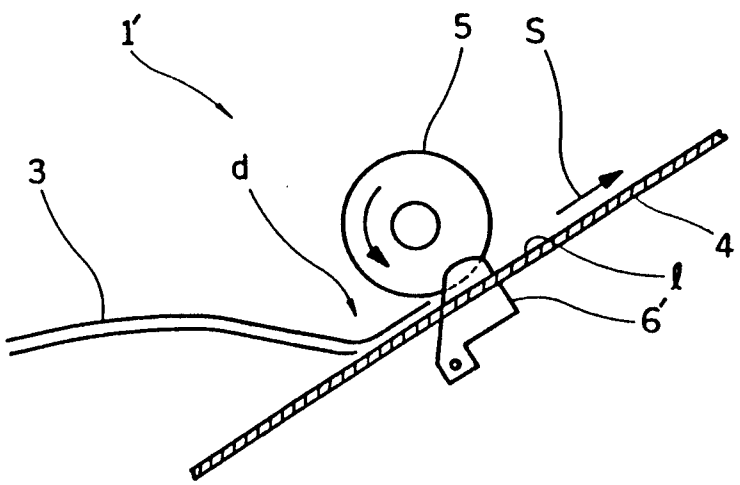
Figure 7:
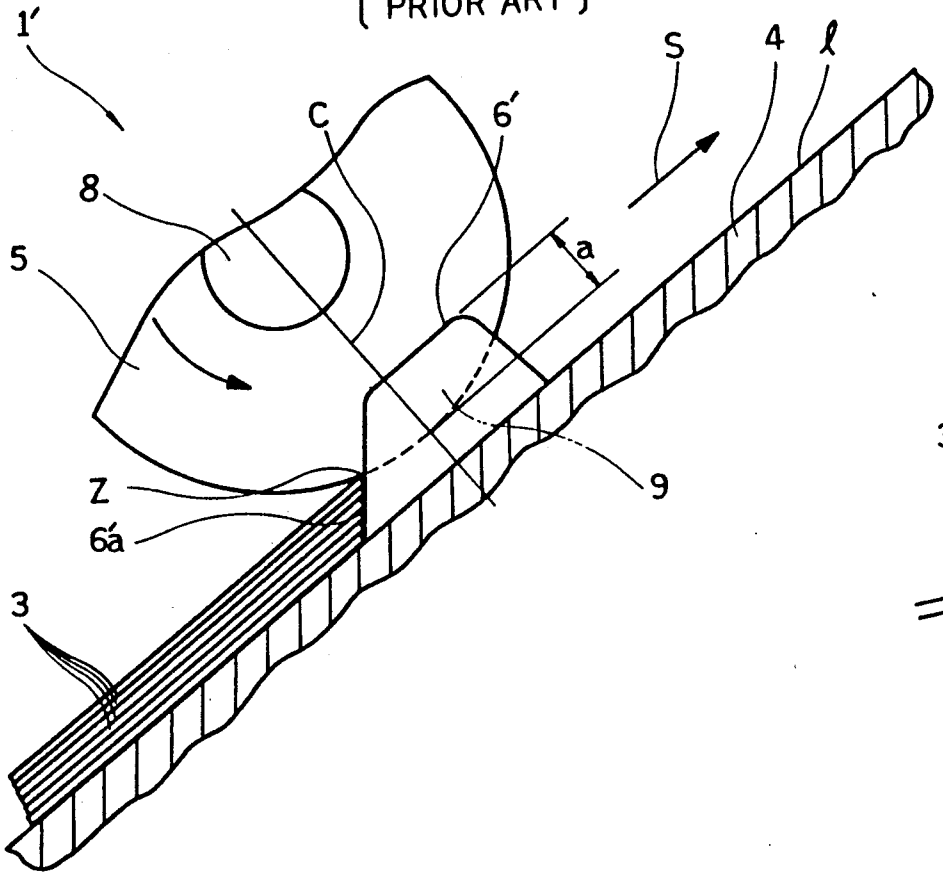

Prior to the description of the preferred embodiment of the invention, it is mentioned that all the elements of the embodiment of the invention which are common to the conventional sheet feeding device shown in FIG. 5 through FIG. 7(*b*) are given the same reference numbers and the explanation therefor is omitted herein.

Figure 1:
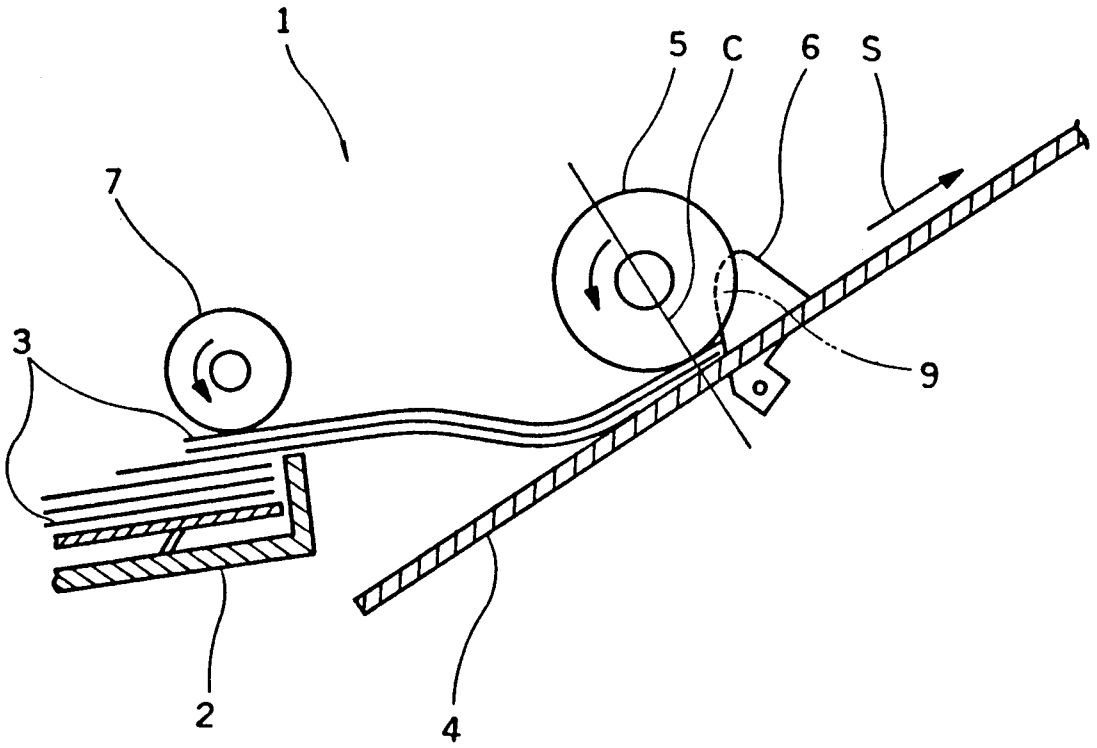
FIG. 1 is a constructional view showing a sheet feeding device according to one of the embodiments of the invention, which is observed from the side thereof.
Figure 2:
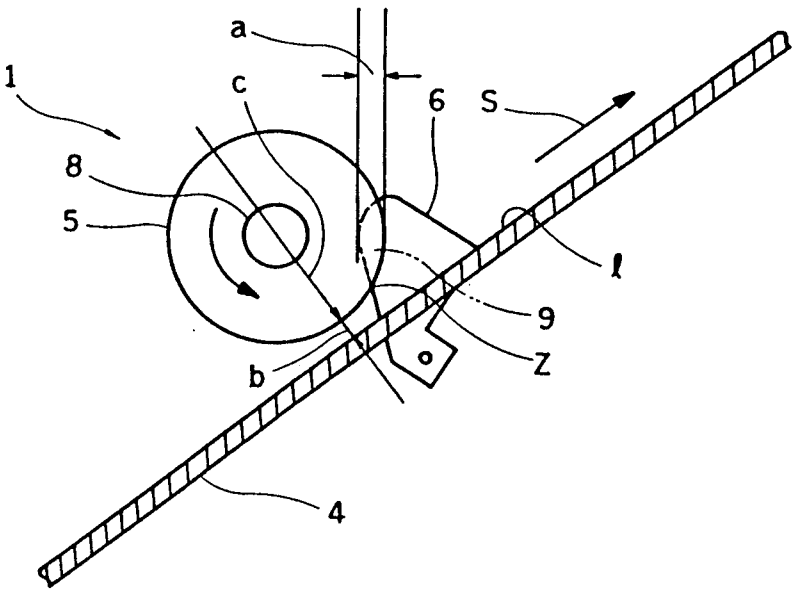
FIG. 2 is a view for explaining the principal parts of the sheet feeding device according to one of the embodiments of the invention.
Figure 3:
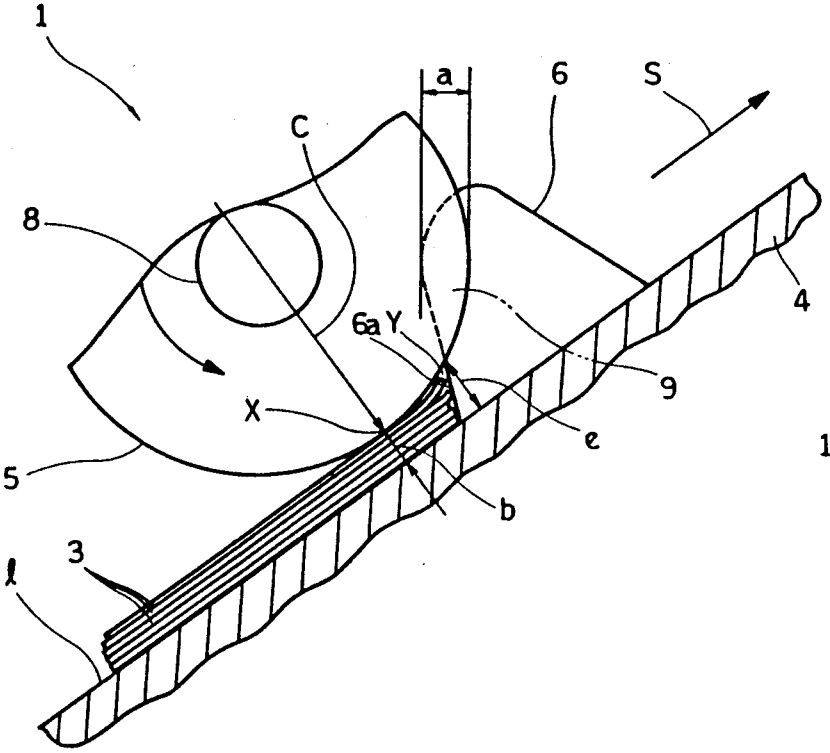
FIG. 3 is a view showing the states that a number of sheets of paper are carried in the principal parts shown in FIG. 2.

A feature which the sheet feeding device 1 according to the embodiment of the invention is different from the conventional sheet feeding device 1' is that a pad 6 having elasticity, which engaged alternately in non-contact with the feeding roller in the axial direction thereof, as one of the examples of separation member to separate sheets of paper 3 sheet by sheet between the feeding roller 5 and the pad 6, is arranged in the downstream side in the sheet feeding direction (an arrow "S") from a minimum clearance portion "b" between the guide plate 4 and the feeding roller 5 as shown in FIG. 1 and FIG. 2. Namely, the separation portion 9 which is formed by that the feeding roller 58 and the pad 6 are engaged alternately in non-contact condition is arranged in the downstream side in the sheet feeding direction from the minimum clearance portion "b". That is, the point "Z" of intersection in the upstream side in the sheet feeding direction between the outer circumference of the feeding roller 5 and the opposite face of the pad 6 opposite to the feeding roller 5 is placed in the downstream side in the sheet feeding direction from the minimum clearance portion "b".

The minimum clearance portion "b" is provided with such clearance as can accommodate one or more sheets of paper 3. And the non-contact engaging width "a" between the feeding roller 5 and the pad 6 is set to such a width that a sheet of paper 3 which is carried in the separation portion 9 can be bent in the axial direction and can pass through the separation portion 9 as well as conventionally (Refer to FIG. 6).

Therefore, in such a sheet feeding device 1 as described in the above, a sheet of paper 3 which is carried in from the intermediate tray 2 by the transfer roller 7 comes in touch with the guide plate 4 at the upstream side in the sheet feeding direction from the minimum clearance portion "b" in the case that the number of sheets of paper is a few, thereafter the sheet of paper 3 is bent along with the guide face "l" and is transferred in the sheet feeding direction on the guide plate 4 toward the separation portion 9.

Furthermore, only the sheet of paper at the uppermost layer is separated by the separation portion 9 and is separated from sheets of paper 3 including the second sheet from above. Accordingly, only the sheet of paper 3 at the uppermost layer is carried out by the feeding roller 5 toward the downstream side in the sheet feeding direction thereof.

In the case that the paper accommodating height "T" (Refer to FIG. 5) of the intermediate tray 2 which is one of the examples of paper pile section is high and there are many of sheets of paper to be simultaneously transferred by the transfer roller 7, a number of sheets of paper carried out from the intermediate tray 2 have comparatively high rigidity. Therefore, they may go straight toward the minimum clearance portion "b" in the upstream side from the separation portion 9.

And even though the leading edge of several sheets of paper 3 passes through the minimum clearance portion "b" and comes in touch with the face 6*a* inclined toward the feeding roller 5 from the guide plate 4, the leading edge of the sheet of paper 3 at the uppermost layer is located in the space "Y" where a clearance portion having larger clearance than the minimum clearance portion "b" between the feeding roller 5 and the guide plate 4 is formed at the downstream side from the above portion "b". For this reason, the leading edge of the sheets of paper 3 becomes comparatively free, thereby causing jamming of the sheets of paper not to occur in the space "Y".

Hence, the sheet send-out force by rotation of the feeding roller 5 operates on the sheets of paper 3 at the portion "X" on the minimum clearance portion "b", thereby causing sheets of paper 3 of which leading edge is in a free condition to be smoothly transferred toward the separation portion 9 along with the face 6*a*, and to be securely separated sheet by sheet at the separation portion 9.

Thus, in the case that in the above sheet feeding device 1 the condition for carrying sheets of paper 3 in toward the separation portion 9 is diversified, the separation portion 9 is formed at the downstream side from the minimum clearance portion "b", and the leading edge of the sheets of paper becomes comparatively free. Therefore, it is possible to separate only the sheet of paper 3 at the uppermost layer without fail and to feed it securely.

Still according to the embodiment of the invention, even though the pad 6 is comparatively roughly adjusted in the case that the pad 6 is moved and adjusted in the right angle direction to the sheet feeding direction, that is, along with the line "C" as the separation portion 9 of the pad 6 for the feeding roller 5 is positioned at the downstream side in the sheet feeding direction from the minimum clearance portion "b", the engaging width "a" of the separation portion 9 is not changed much. Therefore, sheets of paper can be separated sheet by sheet without fail. So, it becomes very easy to adjust the engaging width "a" thereof.

Figure 4:
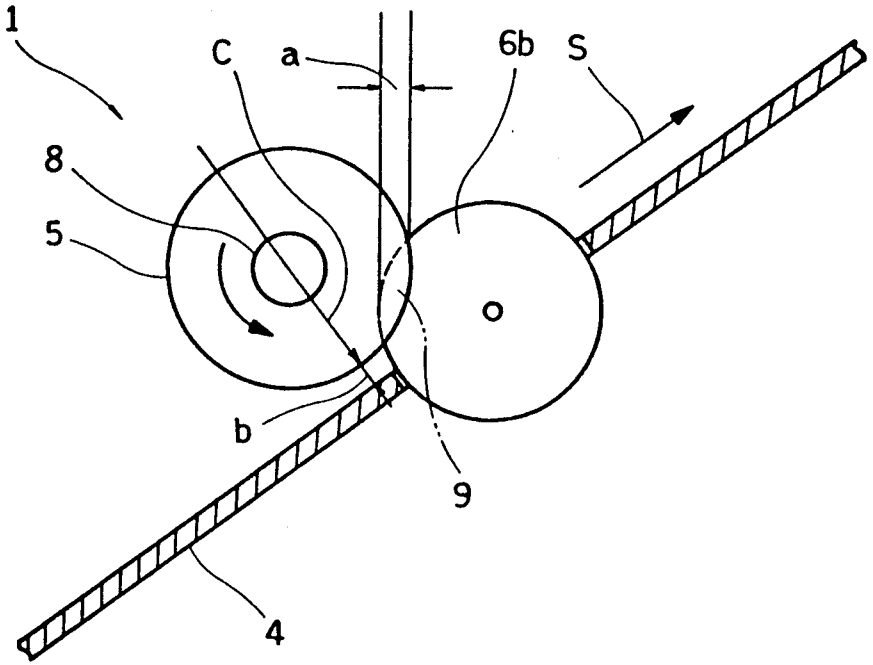
FIG. 4 is a simplified constructional view showing a modification of the separation member provided in the sheet feeding device, which is observed from the side thereof.

Also, the embodiment of the invention shows a sheet feeding device in which the pad 6 is fixed and installed as separation member at the guide plate 4 and which has an inclined face 6*a* for the feeding roller 5. However, the corresponding face may be so formed as to be of curved-surface instead of the inclined face. Also, in this case, sheets of paper 3 can be smoothly guided toward the separation portion 9 along with the curved-surface. As such an example as shown in the above, there is a roller-like pad 6*b* of which axial direction is the same as that of the feeding roller 5 and which is fixed at the guide plate 4 as shown in FIG. 4. Even if the curved-surface to constitute the separation portion 9 is worn in the pad 6*a*, the curved-surface of the other part of the pad 6*b* can be utilized by promptly turning and fixing it around the axis thereof.

Also, in the embodiment of the invention, an intermediate tray in double-side copying is adopted as paper pile section. However, it is not limited to this type. For instance, a usual sheet feeding tray, sheet feeding cassette or sheet feeding deck may be applicable, too.

It will be apparent that many other modifications and variations could be effected by one skilled in the art without departing from the spirit and scope of the novel concept of the invention. Therefore, though the above embodiments are a preferred example, the invention is not limited to the above embodiments.

It can be understood that any modifications and variations which can be produced within the inventive scopes shown in the claims described hereinafter and the scope meant by the claims hereof are all included in the claims attached hereto.

What is claimed is:

1. A sheet feeding device comprising:

a guide member for guiding sheets of paper sent out from the paper pile section in the sheet feeding direction, a feeding roller installed at a fixed position facing the guide member, and which is installed above the guide member and by which a sheet of paper is transferred in the sheet feeding direction, and a separation member provided on said guide member and protruding therefrom which opposes and is engaged in non-contact with the feeding roller in the axial direction thereof and by which sheets of paper can be separated sheet by sheet between the separation member and the feeding roller;

characterized in that a point of intersection at the upstream side in the sheet feeding direction between the outer circumference of the feeding roller and a face of the separation member which opposes the feeding roller is located at the downstream side of the sheet feeding direction with a minimum fixed clearance portion formed between the guide member and the feeding roller and a distance between the point of intersection and the guide member is said to be larger than a clearance distance of the minimum clearance portion.

2. A sheet feeding device claimed in the claim 1 wherein the separation member is a pad having elasticity.

3. A sheet feeding device claimed in the claim 2, wherrein the separation member has a face inclined toward the feeding roller from the guide member.

4. A sheet feeding device claimed in the claim 3, wherein the separation portion is set to such width that the sheets of paper carried in the separation portion can be bent in the axial direction of the feeding roller and can pass through.

5. A sheet feeding device claimed in the claim 2, wherein the separation portion has a curved-surface toward the feeding roller from the guide member.

6. A sheet feeding device claimed in the claim 5, wherein the separation portion is formed to be like a roller of which axial direction is the same as that of the feeding roller.

7. A sheet feeding device claimed in the claim 6, wherein the separation portion is set to such width that the sheets of paper carried in the separation portion can be bent in the axial direction of the feeding roller and can pass through.

* * * * *